United States Patent [19]

Fujita et al.

[11] Patent Number: 4,805,572

[45] Date of Patent: Feb. 21, 1989

[54] CONTROL DEVICE FOR VEHICLE

[75] Inventors: Minoru Fujita, Iwata; Hirotaka Shibata, Hamamatsu, both of Japan

[73] Assignee: Yamaha Hatsudoki Kabushiki Kaisha, Iwtat, Japan

[21] Appl. No.: 846,565

[22] Filed: Mar. 31, 1986

[51] Int. Cl.[4] ..... F02D 9/08; F02D 29/00; F02D 31/00

[52] U.S. Cl. ..... 123/352; 123/336; 123/340; 123/363; 123/376

[58] Field of Search ..... 123/336, 376, 320, 340, 123/349, 363, 403; 180/170, 172

[56] References Cited

U.S. PATENT DOCUMENTS

| | | | |
|---|---|---|---|
| 2,527,352 | 10/1950 | Christian | 123/336 |
| 3,116,807 | 1/1964 | Wilson | 123/336 |
| 3,195,671 | 11/1962 | Wolfe | 123/336 |
| 4,462,357 | 7/1984 | Lockhart | 123/336 |
| 4,484,551 | 11/1984 | Choma | 123/336 |
| 4,531,489 | 7/1985 | Sturdy | 123/376 |

FOREIGN PATENT DOCUMENTS

| | | | |
|---|---|---|---|
| 1017587 | 12/1952 | France | 123/336 |

*Primary Examiner*—Willis R. Wolfe, Jr.
*Attorney, Agent, or Firm*—Ernest A. Beutler

[57] ABSTRACT

Several embodiments of vehicles having automatic or manual speed control. The manual speed control permits the operator to control the speed of the engine and the automatic speed control is effective when a power takeoff shaft is being driven for automatic speed control under this condition. In each embodiment, the automatic speed control includes a governor that is driven only when the power shaft takeoff is being driven. In one embodiment, a throttle valve controls the engine speed and the manual and automatic speed controls alternatively operate the throttle valve through selectively engageable couplings that are operated in response to shifting into and out of the power takeoff mode. A number of other arrangements are also illustrated and described that provide different throttle valve arrangements for controlling the speed automatically or manually.

26 Claims, 9 Drawing Sheets

CONTROL DEVICE FOR VEHICLE

BACKGROUND OF THE INVENTION

This invention relates to a control device for a vehicle and more particularly to an improved automatic speed control arrangement for a vehicle engine.

In many instances, it is desirable to provide for both manual and automatic speed control for an internal combustion engine. For example, if the engine is employed for driving a vehiclee and also driving a power takeoff shaft, there are times when it is desirable to permit the operator to control the speed of the engine and its output shaft at his will. At other times, however, it is desirable to insure automatic speed control so as to insure against variations in speed in the output shafts. For example, many accessories that are driven by a power takeoff shaft have a certain speed rating and it is essential to insure that that speed rating is not exceeded.

It is, therefore, a principal object of this invention to provide an improved arrangement for permitting either manual or automatic speed control of an engine.

It is a further object of this invention to provide an improved and simplified arrangement for permitting shifting between manual and automatic speed control.

In connection with the utilization of the automatic speed control, if the operator must make a separate adjustment to automatic speed control when the power takeoff shaft is being utilized, there is always the danger or possiblility that the operator may inadvertently neglect to shift into the automatic speed control mode.

It is, therefore, a still further object of this invention to provide an arrangement wherein automatic speed control is selected immediately upon the operator selecting the drive of the power takeoff without necessitating a further adjustment or manipulation by the operator.

Governor mechanisms of the type heretofore employed have generally been driven by the engine crankshaft. The crankshaft driven governor is mechanically coupled to a speed controlling element of the engine, normally the carburetor throttle valve, for controlling the speed automatically. However, when the governor is driven by the engine output shaft, it rotates at a much higher speed than the output shaft of the power takeoff. As a result, the governor is quite highly loaded and also must operate over a very wide speed range. Thus, governors of the type heretofore proposed have had to be relatively heavy and also extremely accurate.

It is, therefore, a further object of this invention to provide an automatic speed control mechanism wherein the governor is driven at a lower speed than with the prior art type of devices.

It is a yet further object of this invention to provide a governor mechanism that is driven from the power takeoff shaft and thus will control the actual speed of rotation of the shaft rather than engine speed.

SUMMARY OF THE INVENTION

A first feature of this invention is adapted to be embodied in an internal combustion engine that has a speed controlling element, a manual actuator for operating the speed controlling element and an automatic actuator for operating the speed controlling element. In accordance with this feature of the invention, means are provided for selectively coupling either the manual actuator or the automatic actuator to the speed controlling element for either manual or automatic speed control.

Another feature of the invention is adapted to be embodied in an internal combustion engine that has a first speed controlling element for controlling the speed of the engine and a second speed controlling element for controlling the speed of the engine. A manual operator is provided for the first speed controlling element for manual engine speed control and an automatic operator is provided for the second speed controlling element for automatic speed control. In accordance with this feature of the invention, means are provided for selectively controlling the engine speed from either the manual operator or the automatic operator.

A still further feature of the invention is adapted to be embodied in a vehicle having an engine, transmission means for driving the vehicle from the engine and a speed controlling element for the vehicle. In accordance with this feature of the invention, a governor is driven by a shaft of the transmission for operation of the speed controlling element for maintaining a constant speed of rotation of the shaft.

A still further feature of the invention is adapted to be embodied in a vehicle having an engine, a shaft, clutch means for selectively driving the shaft from the engine and a speed controlling element for the engine. In accordance with this feature of the invention, a governor is adapted to be selectively driven when the clutch is engaged for operating the automatic speed controlling element for maintaining a constant speed of the engine when the clutch is engaged.

DETAILED DESCRIPTION OF THE PREFERRED EMBODIMENTS

Figure 1:
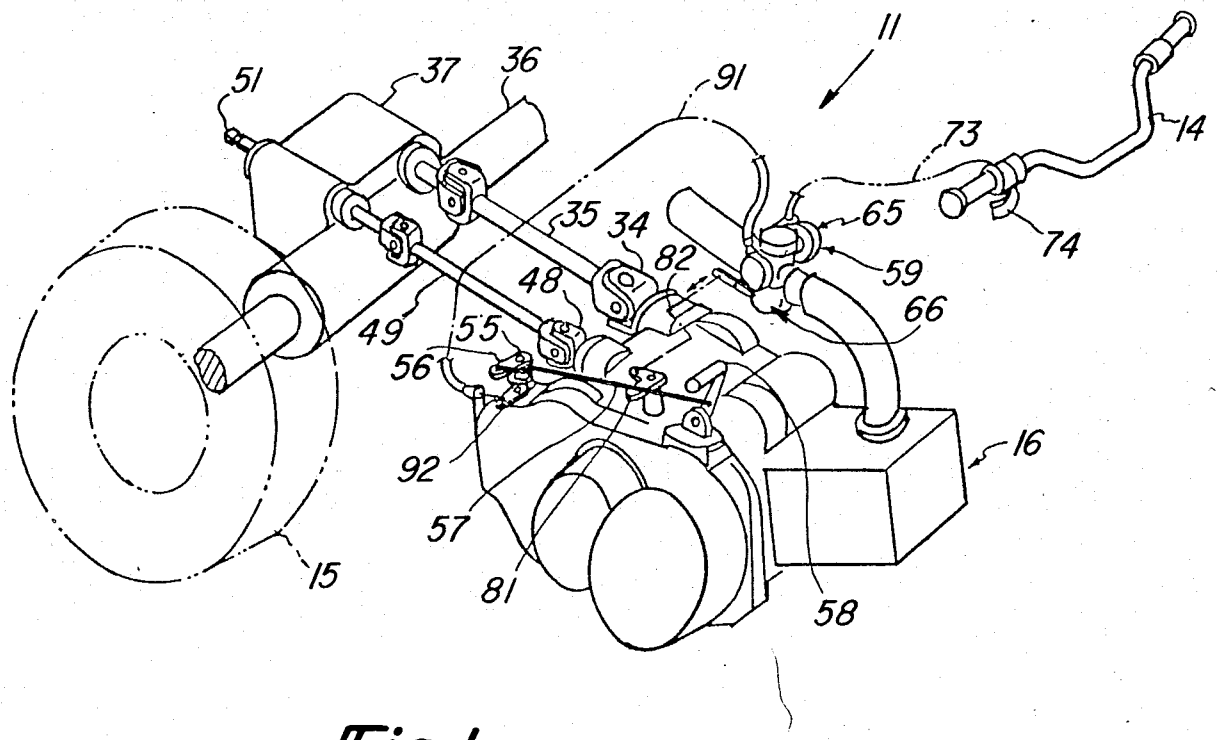
FIG. 1 is a partial perspective view of a motor vehicle constructed in accordance with an embodiment of the invention, with parts shown in phantom and other parts delected to more clearly show the construction.
Figure 2:
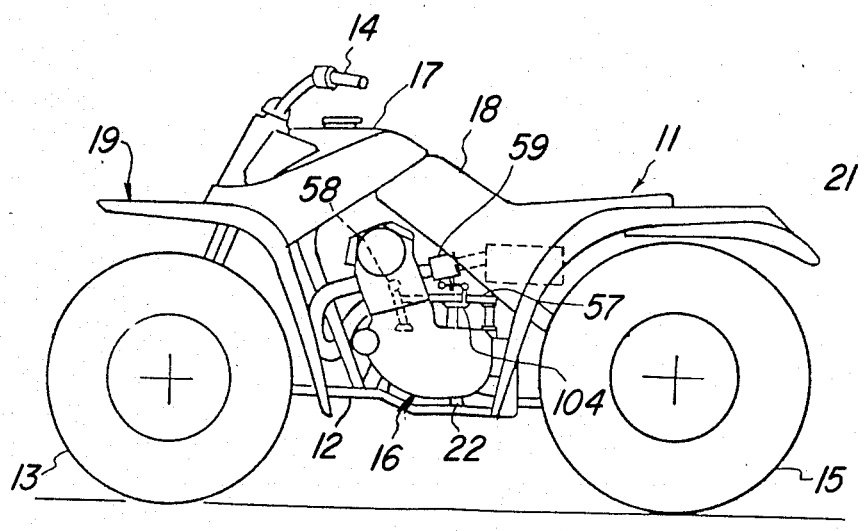
FIG. 2 is a side elevational view of the vehicle.
Figure 3:
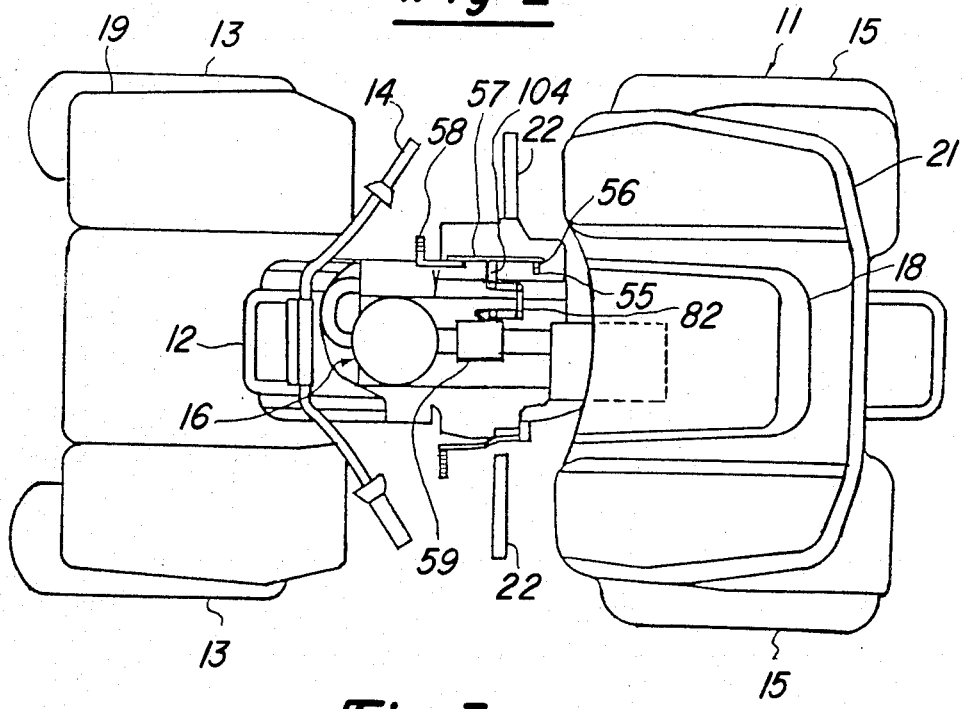
FIG. 3 is a top plan view of the vehicle with a portion removed.

Referring first to FIGS. 1 through 3, a vehicle constructed in accordance with a first embodiment of the invention is identified generally by the reference numeral 11. The vehicle 11 is of the type that is designed to be ridden by a single rider and is designed primarily for off the road use. Specifically, the vehicle 11 is adapted to be utilized for a wide variety of recreational or work purposes such as in the agricultural field for driving a lawnmower, water sprinkler or other known types of applications for such vehicles.

The vehicle 11 includes a frame assembly, indicated generally by the reference numeral 12, and which is depicted as being of the welded up type. Suspended at the front end of the frame 12 for steering and suspension movement are a pair of front wheels that mount low pressure balloon tires 13. The use of such low pressure balloon tires adapts the vehicle 11 particularly for off the road use. The term 'low pressure balloon tires' is used to describe tires of the type that are normally inflated to a pressure in the range of 0.1 to 0.2 kg/cm$^2$. It is to be understood, however, that certain facets of the invention may be utilized in conjunction with vehicles of other types or, in fact, for other applications, as will become apparent.

The front wheels 13 are steered by means of a steering mechanism that includes a handlebar assembly 14 that is supported on the frame assembly 12 and which is coupled to the front wheels 13 for steering them in a known manner.

A pair of rear wheels 15, which also carry low pressure balloon tires, are carried at the rear end of the frame 12. The rear wheels 15 may be suspended, if desired, in any known manner, and are driven from a power plant assembly, indicated generally by the reference numeral 16, and which is supported within the frame assembly 12. The construction and operation of the power plant assembly 16 will be described hereinafter.

A fuel tank 17 is carried by the frame assembly 12 to the rear of the handlebar assembly 14 and above the power plant 16. Positioned rearwardly on the frame 12 from the fuel tank 17 is a saddle type seat 18 that is adapted to accommodate a single rider. A body comprised of a front fender assembly 19 which overlies the front wheels 13 and a rear fender assembly 21, which overlies the rear wheels 15, generally completes the major components of the vehicle 11. The frame 12 further includes a pair of foot pegs 22 that are positioned in a location so as to accommodate the feet of a rider seated upon the seat 18.

The construction of the power unit 16 and the mechanism for driving the rear wheels 15 will now be described by particular reference to FIG. 4. The power unit 16 includes an internal combustion engine, which in the illustrated embodiment, is depicted as of the single cylinder four-cycle type. It is to be understood, however, that the invention may be utilized in conjunction with engines of other types, as will become readily apparent to those skilled in the art. Since the invention is not concerned with the basic components of the engine other than its induction system, those conventional components are not shown.

The engine of the power plant 16 is supported within the frame 12 in such a manner that its output shaft 23 rotates about an axis that extends tranversely relative to the longitudinal center line of the vehicle 11. The output shaft 23, which is a crankshaft in the illustrated embodiment, is contained within a combined crankcase, transmission assembly in which a change speed transmission, indicated generally by the reference numeral 24, is positioned. A centrifugal clutch 25 is affixed to the output shaft 23 of the engine and drives a gear 26 when the speed of rotation of the crankshaft 23 exceeds a predetermined speed. A multi-disk clutch 27 selectively connects the gear 26 to a primary shaft 28 of the change speed transmission 24. There are a plurality of intermeshing gears carried by the primary shaft 28 and a secondary shaft 29 which are coupled to their respective shafts through selectively actuated dog clutches so as to select the speed ratio between the primary shaft 28 and the secondary shaft 29.

A bevel gear 31 is affixed to an outwardly extending end of the secondary shaft 29 and meshes with a bevel gear 32 that is fixed for rotation with an output shaft 33. The output shaft 33 is connected by means of a universal joint 34 to a longitudinally extending drive shaft 35 (FIG. 1). This drive shaft 35 drives a rear axle 36 via a final drive mechanism that is contained within a final drive casing 37.

Referring again to FIG. 4, the gear 26 also is employed for driving a power takeoff mechanism, indicated generally by the reference numeral 38, when the centrifugal clutch 25 is engaged. The power takeoff mechanism 38 includes an input gear 39 which is in mesh with and driven by the gear 26. The gear 39, in turn, drives a gear 41 that is journaled upon a shaft 42. The shaft 42 is adapted to be driven with the gear 41 when a dog clutch mchanism, indicated generally by the reference numeral 43, is engaged. The dog clutch mechanism 43 includes a dog clutch element 44 that is splined for rotation with the shaft 42 and which is axially movable along with it.

The shaft 42 has affixed to one of its ends a bevel gear 45 which, in turn, meshes with a bevel gear 46 that is fixed for rotation with a power takeoff output shaft 47.

The power takeoff output shaft 47 has affixed to it a universal joint 48 which, in turn, drives a power takeoff shaft 49 (FIG. 1). The power takeoff shaft 49 is journaled within the final drive housing 37 and has an output end 51 that forms a coupling to which any known type of accessory, such as a lawnmower, sprinkler or the like may be attached in a known manner.

Figure 4:
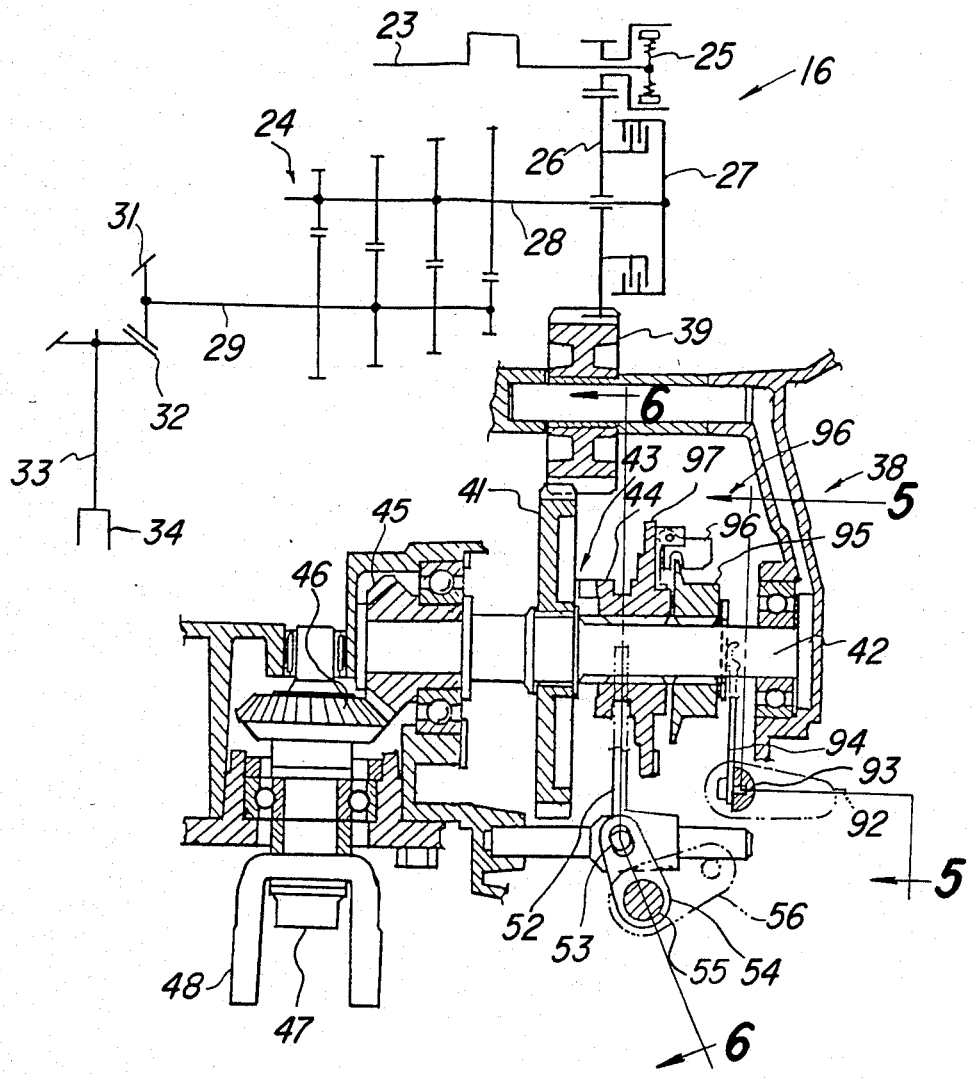
FIG. 4 is a partially schematic view showing the relationship between the engine and the transmission of the vehicle.
Figure 6:
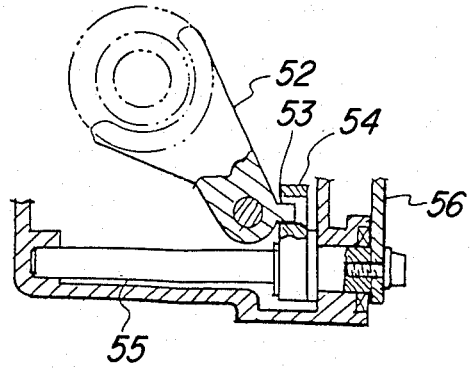
FIG. 6 is an enlarged cross-sectional view taken along the line 6—6 of FIG. 4.

The operation of the dog clutch 43 may be best understood by reference to FIGS. 4 and 6. A shifting fork 52 is received within a groove in the dog clutching element 44 and has a lug 53 that is received within a recess formed in a shifting lever 54. The shifting lever 54 is, in turn, affixed to a shaft 55 which is journaled within the transmission housing in an appropriate manner. Affixed to an extending end of the shaft 55 is a lever 56. The lever 56 has pivotally connected to it one end of a link 57 (FIG. 1). The other end of the link 57 is pivotally connected to a changeover or power takeoff lever 58 that is positioned on the vehicle adjacent to one side of the power unit 16. As seen in the figures, the power takeoff dog clutch 43 is normally not engaged when the power takeoff lever 58 is in a rearward position. When the operator pushes the lever 58 forwardly, a force will be exerted through the link 57 that rotates the lever 56 and effects sliding movement of the shifting fork 52 to the left as seen in FIG. 4 so that the dog clutch 43 is engaged and the power takeoff shaft 49 will be driven when the speed at which the centrifugal clutch 25 is engaged is exceeded.

Figure 7:
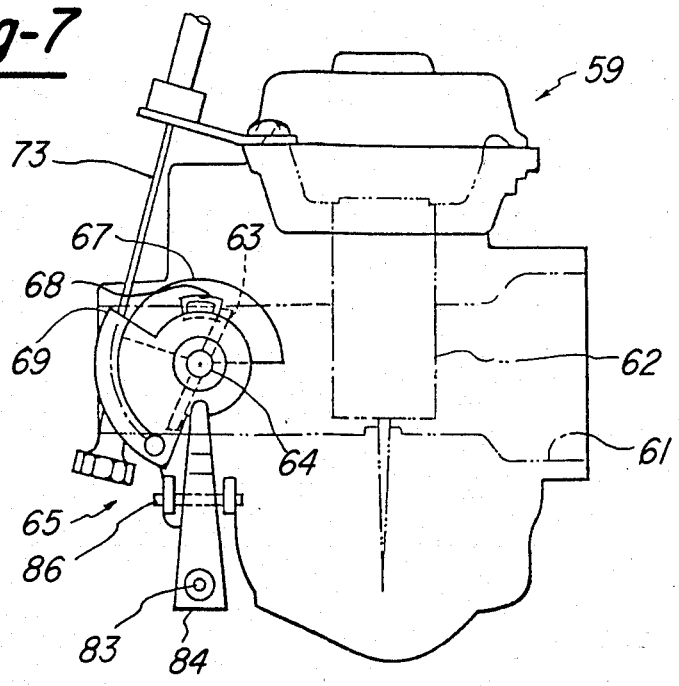
FIG. 7 is a side elevational view of the carburetor of this embodiment.
Figure 8:
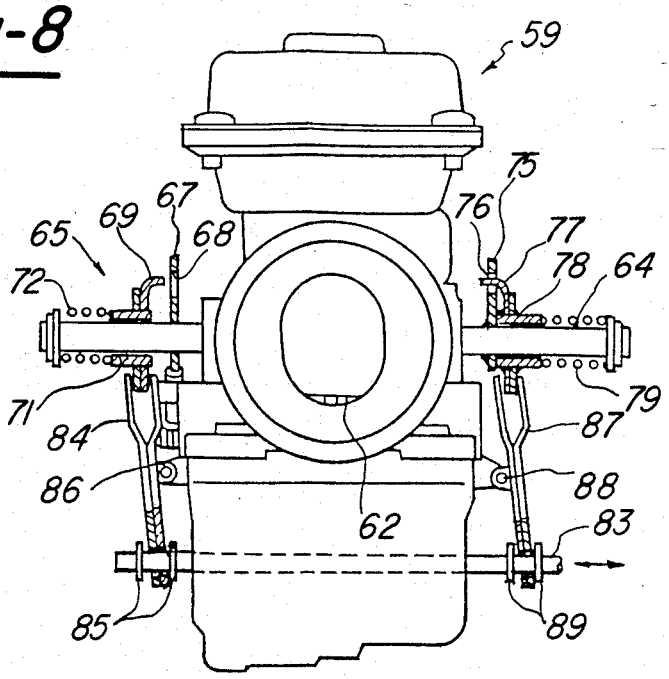
FIG. 8 is an end elevational view of the carburetor, with portions shown in section.

Referring now primarily to FIGS. 1, 7 and 8, the power unit 16 includes a charge forming device in the form of a carburetor 59. The carburetor 59 is, in the illustrated embodiment, of the air valve type and includes an induction passage 61 in which a sliding piston 62 is supported. The sliding piston 62 moves to a position so as to control the effective cross-sectional area of the induction passage 62, as is well known in this art.

A throttle valve 63 is positioned in the induction passagee 61 downstream of the sliding piston 62 for controlling the speed of the power unit 16. The throttle valve 63 is affixed to a throttle valve shaft 64 that is journaled in the body of the carburetor 59 and which extends outwardly from each side thereof.

At one side of the carburetor 59, a manually operated throttle valve actuator, indicated generally by the reference numeral 65, is provided for manual control of the throttle valve 63. At the opposite side, there is provided a governor throttle valve control 66 which is operated by means of a governor, to be described, for automatic speed control of the power unit 16. FIG. 8 shows the arrangement wherein the carburetor is under governor control.

The manual throttle actuator 65 includes an arcuate sector 67 that is affixed for rotation with the throttle valve shaft 64 and which has an opening or slot 68 formed in it. A lever 69 is affixed to a bushing 71 and is slidably supported on the shaft 64 adjacent the sector 67. The lever 69 has an inturned tank which is adapted to engage in the slot 68 so as to mechanically couple the lever 69 to the sector 67. A coil compression spring 72 normally urges the lever 69 to its engaged position with the sector 67.

The lever 69 has affixed to it one end of a wire transmitter 73, the opposite end of which is affixed to a manual throttle control 74 carried by the handlebar assembly 14.

The governor throttle actuator 66 includes a sector 75 that is affixed to the throttle valve shaft 64 and which has a slot 76. A lever 77 is juxtaposed to the sector and has an inturned tang which is adapted to engage the slot 76 for rotatably coupling the lever 77 and sector 75. The lever 77 is affixd to a bushing 78 which is slidably supported on the throttle valve shaft 64 and which is urged to engaged position by means of a coil compression spring 79.

A mechanism is provided for automatically actuating the manual throttle valve actuator 65 and governor throttle valve actuator 66 in response to movement of the change over lever 58. This mechanism includes a bellcrank 81 that is pivotally supported on a casing of the power unit 16 and which has one of its arms connected to the link 57 for rotation of the bellcrank 81 upon actuation of the link 57 (FIG. 1). The other arm of the bellcrank 81 is connected by means of a link 82 to a sliding rod 83 (FIG. 8) that is slidably supported in the body of the carburetor 59. The control rod 83 operates a first fork 84, one end of which is trapped between a pair of washers 85 affixed to the manual throttle valve actuator side of the carburetor 59. The fork 84 is pivotally supported on the carburetor body by means of a pivot pin 86. The end of the fork 84 remote from the rod 83 receives the link 69 for moving the link 69 upon pivotal movement of the fork 84 about the pivot pin 86.

In a similar manner, a fork 87 is pivotally supported on the side of the carburetor body 59 adjacent the governor throttle control 66 by means of a pivot pin 88. The lower end of the fork 87 is received between a pair of washers 89 that are staked to the control rod 83. The opposite end of the fork 87 encircles the lever 77 for sliding it along the shaft 64.

Figure 5:
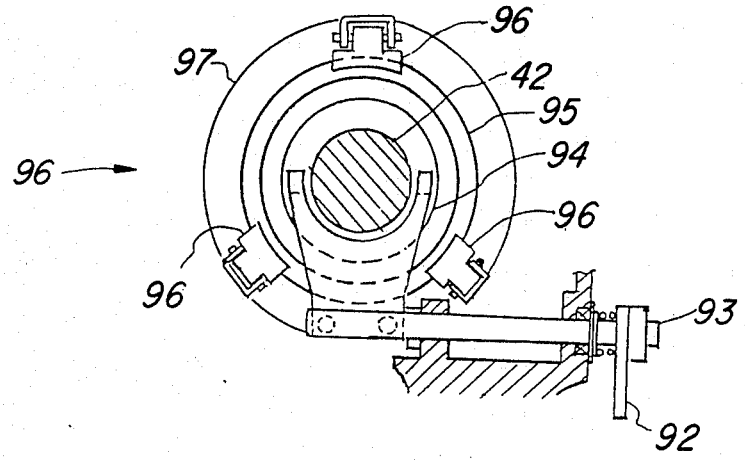
FIG. 5 is an enlarged cross-sectional view taken along the line 5—5 of FIG. 4.

The governor operator lever 77 is connected by means of a flexible transmitter 91 to a governor control lever 92. The governor control lever 92 is affixed to a shaft 93 (FIGS. 4 and 5) which is journaled in the transmission assembly. A fork 94 is connected to the shaft 93 and extends into the transmission and is engaged with one side of a bushing 95 of a governor assembly, indicated generally by the reference numeral 96. The bushing 95 is slidably supported on the shaft 42 and has a peripheral flange that is engaged within a plurality of centrifugal weights 96 that are supported on an annular flange 97 of a member that is affixed for rotation with the dog clutching element 44.

This embodiment works as follows. The rear wheels 15 are powered through the change speed transmission 24 when the multiple disk clutch 27 is engaged and when the speed of rotation of the engine crankshaft 23 is sufficient to effect engagement of the centrifugal clutch 25. It is believed that this mechanism is well known to those skilled in the art and, therefore, a more detailed description of its construction and operation is not believed to be necessary. It should be noted, however, that when the power takeoff shaft 49 is not being driven, the change over lever 58 will be in such a position that the rod 83 will have been shifted to the left as viewed in FIG. 8 so that the lever 69 is coupled for rotation with the sector 67 and the lever 77 is out of engagement with the sector 75 so that the throttle valve control will be under the operator manual lever 74 through the manual throttle valve actuator mechanism 65.

If the arrangement is shifted into the power takeoff mode, the accessory is connected to the power takeoff shaft adapter 51 in a known manner. The operator then moves the power takeoff lever 58 forwardly so as to exert a force through the link 57 on the lever 56. This will cause the shifting fork 52 to be slid along the shaft 42 so as to engage the dog clutch 43.

At the same time, the control rod 103 will be pulled to the right as shown in FIG. 8 and the lever 69 will be moved out of engagement with the sector slot 68 and the lever 77 will be moved into engagement with the sector slot 76 so that the throttle valve of the carburetor is now under governor control through the mechanism 66.

When the shaft 42 is not rotating, the centrifugal weights 96 will be moved radially inwardly so that the collar 95 will be slid and followed by the fork 94 so that the control wire 91 will be tensioned to rotate the lever 79 and throttle valve shaft 64 so as to fully open the throttle valve 63. As the speed of the shaft 42 and, accordingly, the power takeoff shaft 49 increases, the centrifugal weights 96 will pivot outwardly so as to move the collar 95 to the right as shown in FIG. 4. This will pivot the fork 94 and shaft 93 so as to pivot the lever 92 and cause the throttle valve 63 to become closed until the speed of the shaft 42 reaches the governed speed and it will be maintained at that speed. Therefore, the speed of the power unit 16 will be regulated so that the speed of the power takeoff shaft is maintained constant at the predetermined and required speed. In this way, it will be insured that the speed of the accessory driven by the power takeoff shaft will not exceed its rated speed.

In the embodiment of FIGS. 1 through 8, both manual and governed speed control was provided by operating the same speed controlling element, in the form of the throttle valve 63 of the carburetor 59. This was accomplished by selectively coupling either the manual throttle control 65 or the governor throttle control 66 to the throttle valve shaft 64. It is to be understood, however, that certain facets of this invention may be employed wherein the automatic and manual throttle controls are separate elements and such elements are shown in the embodiments of FIGS. 9 through 15.

Figure 9:
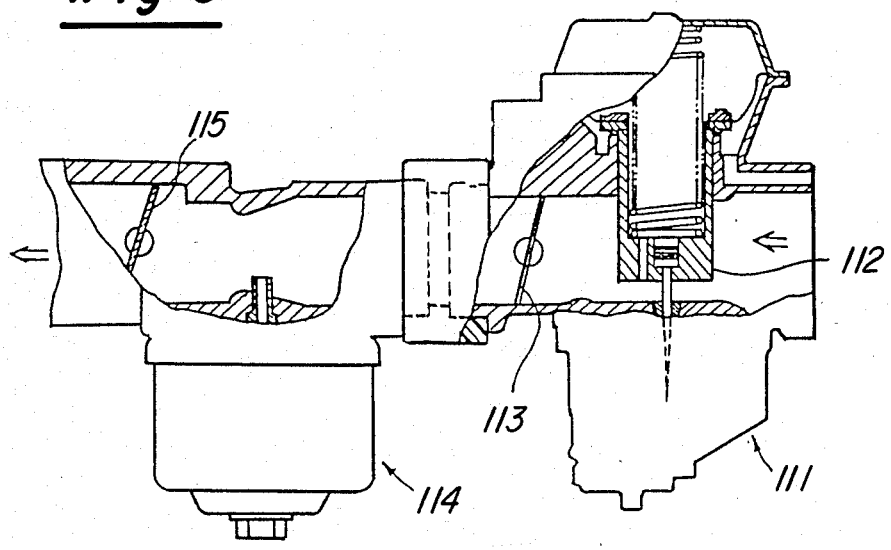
FIG. 9 is a side elevational view, with portions broken away, of a speed controlling arrangement constructed in accordance with another embodiment of the invention.

Referring first to the embodiment of FIG. 9, a manually controlled carburetor 111 of the air valve type is provided with an automatic air valve 112 for controlling the effective size of the venturi to maintain a constant pressure drop through the carburetor 111. A manually operated throttle valve 113 is positioned downstream of the air valve 112 for manual throttle control. A governor controlled carburetor 114 is positioned in series with and downstream of the manual carburetor 111. The governor carburetor 114 includes a throttle valve 115 which is controlled by the governor.

In this embodiment, an arrangement is provided so that when the change over lever 58 is in the non-power takeoff mode, the manual carburetor 11 controls engine speed by its throttle valve 113 and the governor carburetor 114 is positioned so that its throttle valve 115 is held in an opened position. During governor control, the throttle valve 113 of the manual carburetor 111 is held open and the throttle valve 115 of the governor carburetor 114 is operated by the governor. A suitable linkage system similar to that shown in FIGS. 1 through 8 may be employed for this purpose.

Figure 10:
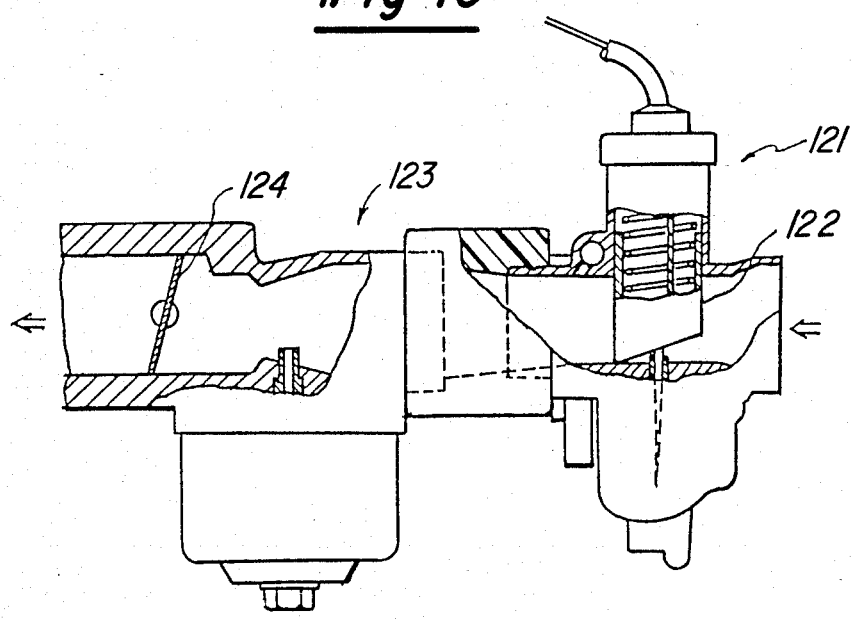
FIG. 10 is a side elevational view, with portions broken away, of a still further embodiment of a speed controlling arrangement.

FIG. 10 shows an embodiment that is similar to FIG. 9, however, in this embodiment, a manual carburetor 121 is provided with a manual throttle valve in the form of a sliding piston 122. Downstream of the manual carburetor 121 and in series relationship with it is a governor carburetor 123 having a governor controlled throttle valve 124. The throttle valves 122 and 124 are interrelated with each other for either manual or governor operation as with the embodiment of FIG. 9.

Figure 11:
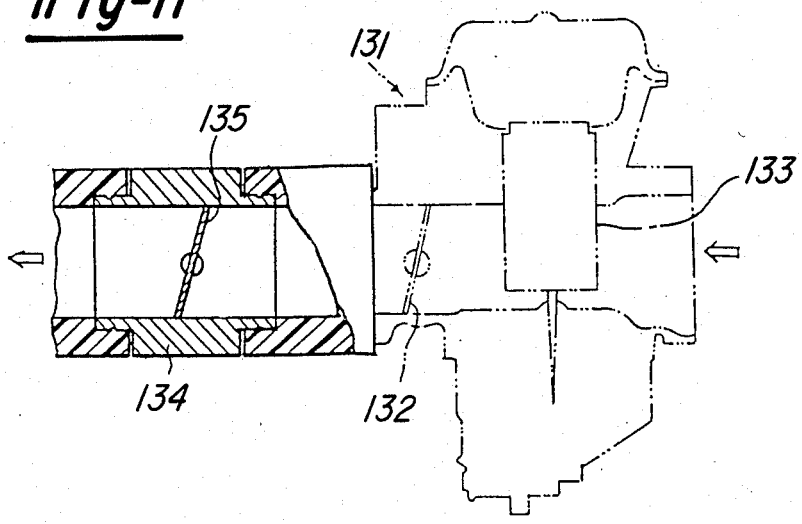
FIG. 11 is a side elevational view, in part similar to FIGS. 7, 9 and 10, with portions broken away and other portions shown in phantom, of a further embodiment of the invention.
Figure 12:
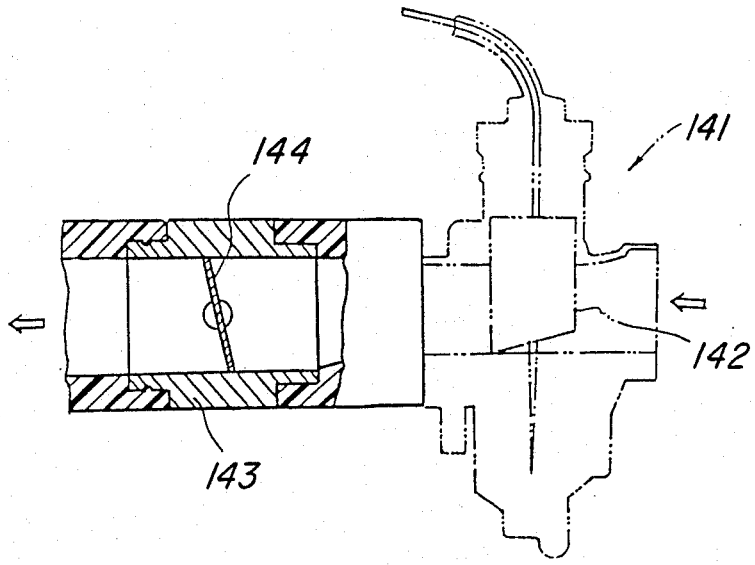
FIG. 12 is a side elevational view, in part similar to FIGS. 7, 9, 10 and 11, with portions broken away and other portions shown in phantom, of yet another embodiment of the invention.

In the embodiment of FIGS. 9 and 10, there were employed two carburetors in series relationship with each other. As a result, each carburetor contributes to the fuel flow to the engine regardless of whether there is manual or governor control. FIGS. 11 and 12 show embodiments wherein the governor controlled device is merely a throttle valve and not a carburetor.

Referring first to FIG. 11, there is provided a manual carburetor 131 of the air valve type having an automatically operated sliding piston 133 and a manually operated throttle valve 132. Downstream of the carburetor 131, there is provided a throttle body 134 in which a governor controlled throttle valve 135 is positioned. The throttle valves 132 and 135 are operated in the same manner as the respective throttle valves 113, 115 and 112, 124 of the embodiments of FIGS. 9 and 10.

FIG. 12 shows an embodiment wherein the manual carburetor 141 includes a manually operated sliding piston throttle valve 142. Downstream of it, there is provided a throttle body 143 in series flow relationship in which a manually operated throttle valve 144 is positioned. The throttle valves 142 and 144 are interrelated for manual or automatic throttle valve operation as with the previously described embodiments.

Figure 13:
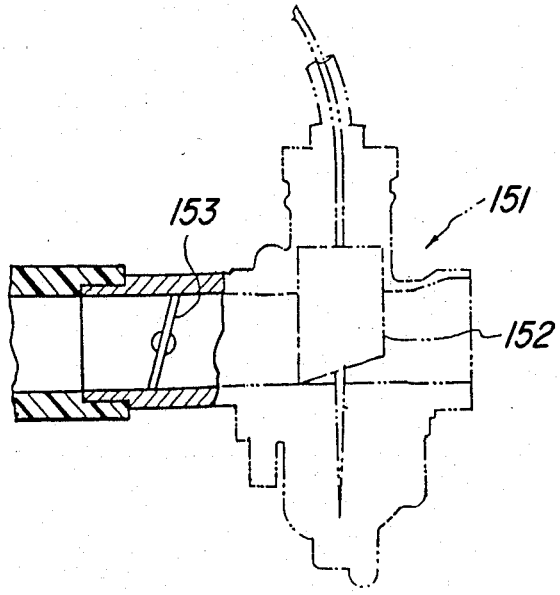
FIG. 13 is a side elevational view, in part similar to FIGS. 7 and 9 through 12, with portions broken away and other portions shown in phantom, of yet another embodiment of the invention.

Rather than providing the governor throttle valve in a separate throttle body, the governor operated throttle valve may be positioned in the same body as the carburetor and FIG. 13 shows such an embodiment. In this embodiment, a carburetor 151 is provided with a manually operated sliding piston throttle valve 152 and a governor operated throttle valve 153. The relationship between the throttle valve 152 and 153 is as aforedescribed.

Figure 14:
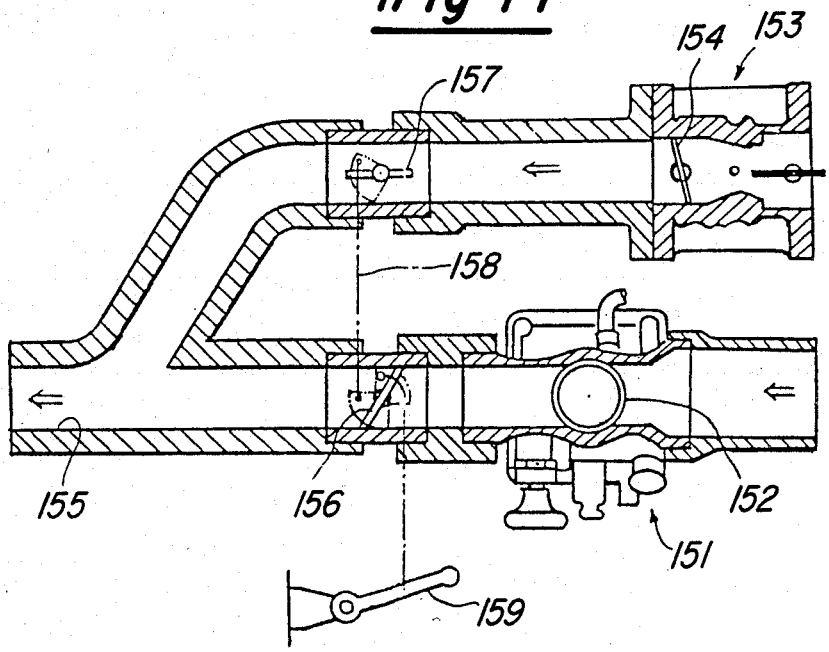
FIG. 14 is a cross-sectional view showing another embodiment of speed controlling arrangement.

In the embodiments of FIGS. 9 through 13, the manual and governor operated throttle valves are positioned in series relationship with each other. It is to be understood that they may also be positioned in parallel flow relationship and FIG. 14 shows one such embodiment. In this embodiment, there are provided parallel flow paths comprising a manually operated carburetor 151 in which a sliding piston throttle valve 152 is positioned. The throttle valve 152 is operated manually under operator control in a known manner.

In a parallel conduit, there is provided a governor carburetor 153 in which a governor controlled throttle valve 154 is positioned. The governor throttle valve 154 is operated by a governor mechanism of the type as aforedescribed.

In this embodiment, there are provided a pair of throttle valves 156 and 157 downstream of the carburetors 151 and 152. The throttle valves 156 and 157 are interconnected by means of a link 158 and control the flow into a passage 155 that feeds the engine induction system. The arrangement is such that when the throttle valve 156 is closed, the throttle valve 157 is opened and vice versa.

A lever 159 is connected to the throttle valve 156 and, through the link 158, to the throttle valve 157 so as to control these two throttle valves simultaneously. The lever 159 is connected by means of a link to the change over lever, in a manner similar to the embodiment of FIGS. 1 through 8, so that when the power takeoff shaft is not being driven, the throttle valve 157 will be closed and the throttle valve 156 will be opened. Under this condition, the manual carburetor 151 controls the speed of the engine. When the change over lever is moved to energize the drive for the power takeoff by engaging the dog clutch, the throttle valve 156 is closed and the throttle valve 157 is opened so that the governor carburetor 153 will control the engine speed.

Figure 15:
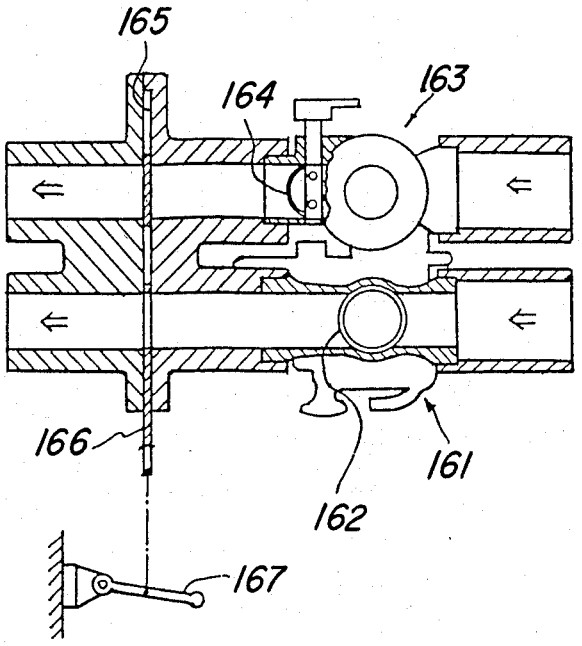
FIG. 15 is a cross-sectional view, in part similar to Figure 14, showing yet another embodiment of speed controlling mechanism.

FIG. 15 shows another parallel flow arrangement embodying a different throttle valve mechanism for determining which carburetor controls the engine speed. In this embodiment, a manually operated carburetor 161 is provided with a sliding piston throttle valve 162 which is manually operated. A governor carburetor 163 is provided in a parallel conduit and has a governor controlled throttle valve 164. A slot 165 is formed in a base of the carburetors 161 and 163 and receives a sliding valve plate 166. The valve plate has openings in it so that its position will determine which carburetor 161 or 163 controls the engine speed. In FIG. 15, the manual carburetor 161 supplies the charge to the engine while the governor carburetor 163 has its induction passage closed by the valve plate 166. The valve plate 166 is reciprocated by a lever 167 that is coupled to the change over lever through a linkage system as described in conjunction with the embodiment of FIGS. 1 through 8.

It should be readily apparent from the foregoing description that a number of embodiments of the invention have been illustrated and described and in which the engine speed is controlled manually when the power takeoff shaft is not driven and automatically by a governor mechanism upon driving of the power takeoff shaft. Therefore, there is no likelihood of danger to over speed operation of the driven element since it cannot be driven until the governor speed control is in effect. In addition, the governor was driven by the transmission for the power takeoff shaft and, hence, was only operative when the power takeoff shaft was being driven and furthermore was driven at a lower speed than the prior art type of devices wherein the governor is driven directly from the engine. Although a number of embodiments of the invention have been illustrated and described, various changes and modifications may be made without departing from the spirit and scope of the invention, as defined by the appended claims.

We claim:

1. In an internal combustion engine having a speed controlling element moveable in speed increasing and speed decreasing directions, a manual actuator for operating said speed controlling element inboth said speed increasing and said speed decreasing directions, and an automatic actuator for operating said speed controlling element in both said speed increasing and said speed decreasing directions, the improvement comprising means for selectively coupling either said manual actuator or said automatic actuator to said speed controlling element for either manual or automatic speed control in both the speed increasing and speed decreasing directions.

2. In an internal combustion engine as set forth in claim 1 wherein the means for selectively coupling couples one of the actuators and simultaneously uncouples the other of the actuators from the speed controlling element.

3. In an internal combustion engine as set forth in claim 2 wherein the means for selectively coupling provides a direct mechanical coupling.

4. In an internal combustion engine as set forth in claim 1 wherein the speed controlling element comprises a throttle valve.

5. In an internal combustion engine as set forth in claim 4 wherein the throttle valve is positioned within a carburetor of the engine induction system.

6. In an internal combustion engine as set forth in claim 5 wherein the means for selectively coupling couples one of the actuators and simultaneously uncouples the other of the actuators from the throttle valve.

7. In an internal combustion engine as set forth in claim 6 wherein the means for selectively coupling provides a direct mechanical coupling.

8. In an internal combustion engine as set forth in claim 1 in combination with a vehicle powered by the engine.

9. In an internal combustion engine as set forth in claim 8 wherein the engine drives a transmission.

10. In an internal combustion engine as set forth in claim 9 wherein the transmission drives a power takeoff shaft through a selectively operable clutch, the means for selectively coupling the actuators to the throttle valve being operated in response to actuation of said clutch.

11. In an internal combustion engine as set forth in claim 10 wherein the speed controlling element comprises a throttle valve.

12. In an internal combustion engine as set forth in claim 11 wherein the means for selectively coupling couples one of the actuators and simultaneously uncouples the other of the actuators from the throttle valve.

13. In an internal combustion engine as set forth in claim 12 wherein the means for selectively coupling provides a direct mechanical coupling.

14. In an internal combustion engine as set forth in claim 9 wherein the automatic speed controlling element comprises a governor.

15. In an internal combustion engine as set forth in claim 14 wherein the governor is driven by a transmission shaft.

16. In an internal combustion engine as set forth in claim 15 wherein the governor is driven simultaneously with the power takeoff shaft.

17. In a vehicle having an engine, transmission means for driving said vehicle from said engine, and a speed controlling element for said vehicle moveable in speed increasing and speed decreasing direction, the improvement comprising a governor driven by a shaft of said transmission for operating said speed controlling element in either the speed increasing or speed decreasing directions for maintaining a constant speed of rotation of said shaft.

18. In a vehicle as set forth in claim 17 wherein the shaft drives a power takeoff.

19. In a vehicle as set forth in claim 18 wherein the speed controlling element comprises a throttle valve.

20. In a vehicle as set forth in claim 19 wherein the throttle valve is positioned within a carburetor of the engine induction system.

21. In a vehicle as set forth in claim 17 further including a selectively engageable clutch for driving the power takeoff shaft.

22. In a vehicle as set forth in claim 21 wherein the automatic speed controlling elementis operative when the clutch driving the power takeoff shaft is engaged and further including a manual speed control for controlling the speed of the engine when the power takeoff clutch is disengaged.

23. In a vehicle as set forth in claim 22 wherein the selective manual and automatic speed control is operative in response to movement of the clutch between its engaged and disengaged positions.

24. A vehicle having an engine, a clutch operatively associated with said engine for driving a shaft when said clutch is engaged and for permitting the engine to run without driving the shaft when said clutch is disengaged, a speed controlling element for said engine for increasing and decreasing the speed of said engine, and means for automatically increasing or decreasing the speed of said engine when said clutch is engaged to maintain a desired engine speed and for permitting manual speed control when said clutch is disengaged.

25. A vehicle as set forth in claim 24 wherein the clutch drives a power takeoff shaft.

26. A vehicle as set forth in claim 25 wherein the automatic speed control includes a governor driven by the power takeoff shaft.

* * * * *